United States Patent [19]

Fuller

[11] Patent Number: 4,648,559

[45] Date of Patent: Mar. 10, 1987

[54] ELECTROMAGNETICALLY ACTUATABLE FLUID VALVE

[75] Inventor: William A. Fuller, St. Clair Shores, Mich.

[73] Assignee: Colt Industries Operating Corp, New York, N.Y.

[21] Appl. No.: 794,450

[22] Filed: Nov. 4, 1985

[51] Int. Cl.[4] ..... F02M 51/06

[52] U.S. Cl. ..... 239/585; 29/157.1 R; 251/52; 251/129.22

[58] Field of Search ..... 239/585, 533.3, 533.12; 251/50–52, 129.14, 129.15, 129.22; 29/157.1 R, 213 R, 464, 525

[56] References Cited

U.S. PATENT DOCUMENTS 3,107,893 10/1963 Bashe ..... 251/129.14 X
4,264,040 4/1981 Saito ..... 239/585
4,434,765 3/1984 Eshelman ..... 239/585 X
4,481,699 11/1984 Knapp et al. ..... 251/129.14

*Primary Examiner*—Andres Kashnikow
*Attorney, Agent, or Firm*—Walter Potoroka, Sr.

[57] ABSTRACT

A duty-cycle type electromagnetic injector assembly has a valve and cooperating valve seat with the valve being positioned away from or against the valve seat depending upon whether an associated electrical coil is energized; a housing generally contains the valve and valve seat, a locator or guide closely confines the valve permitting the valve to be freely moved toward and away from the valve seat while constraining movement of the valve in other directions; the locator or guide is in turn prevented from movement by a retainer operatively connected to the housing and frictionally engaging the locator or guide.

21 Claims, 6 Drawing Figures

ELECTROMAGNETICALLY ACTUATABLE FLUID VALVE

FIELD OF THE INVENTION

This invention relates generally to fuel injection systems and more particularly to injector assemblies whereby fuel is metered and injected into the fuel induction system of an associated combustion engine.

BACKGROUND OF THE INVENTION

The automotive industry is continually striving to attain reductions in engine fuel consumption and among the various systems and devices proposed heretofore by the prior art is the use of a duty-cycle type of electromagnetic fuel metering valving assembly. Generally, as is well known in the art, such duty-cycle valving assemblies employ a generally cyclically energized field coil which causes an associated armature-positioned valving member to open and close against a cooperating valve seating surface to intermittently permit and cease fuel flow to the engine. Generally, the average amount of time, within a given span of time, that the valve member is opened will determine the then metered rate of fuel flow to the engine.

In such duty-cycle valving assemblies an important requirement is that the valving assembly deliver the precise rate of metered fuel flow then required by the engine. In this area, the prior art has had difficulty, to say the least, in obtaining a valving member which when seated operated to fully and assuredly terminate fuel flow therepast. Often, the valve member selected comprises a generally spherical valving surface intended to seat against a cooperating valve seating surface. Since the various elements comprising such duty-cycle injector or valving assemblies are manufactured separately, the inter-related concentricities thereof become an important factor in ultimately determining whether required valve seating and fuel flow sealing characteristics are obtainable. The duty-cycle injector or valving assemblies heretofore proposed by the prior art and which have found acceptance, in terms of performance, require very precise and expensive machining processes in order to attempt to attain the required concentricities of, for example, the armature-positioned valve member and valve seat means.

The invention as herein disclosed and described is primarily directed to the solution of the aforestated problems of the prior art and to provide structure which is comparatively inexpensive to produce and yet provide the required seating of the valving member and the attendant required termination of fuel flow therepast.

SUMMARY OF THE INVENTION

According to the invention, a duty-cycle type injector assembly having a valving member and cooperating valve seating means, wherein the valving member is positioned away from or against said valve seating means depending upon the energization and de-energization of associated field coil means, comprises housing means for the containment of said valving member and said valve seating means, locator means closely confining said valve member as to allow said valve member to be freely moved in first directions toward and away from said valve seating means while constraining movement of said valve member in second directions perpendicularly transverse to said first directions, wherein when said valve member is fully seated against said valve seating means said locator means is in a spaced condition from said housing means in directions which are generally parallel to said second directions, and locking means operatively engaging said locator means and said housing means for maintaining said locator means in said spaced condition regardless of whether said valve member has been moved away from said valve seating means or toward and seated against said valve seating means.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
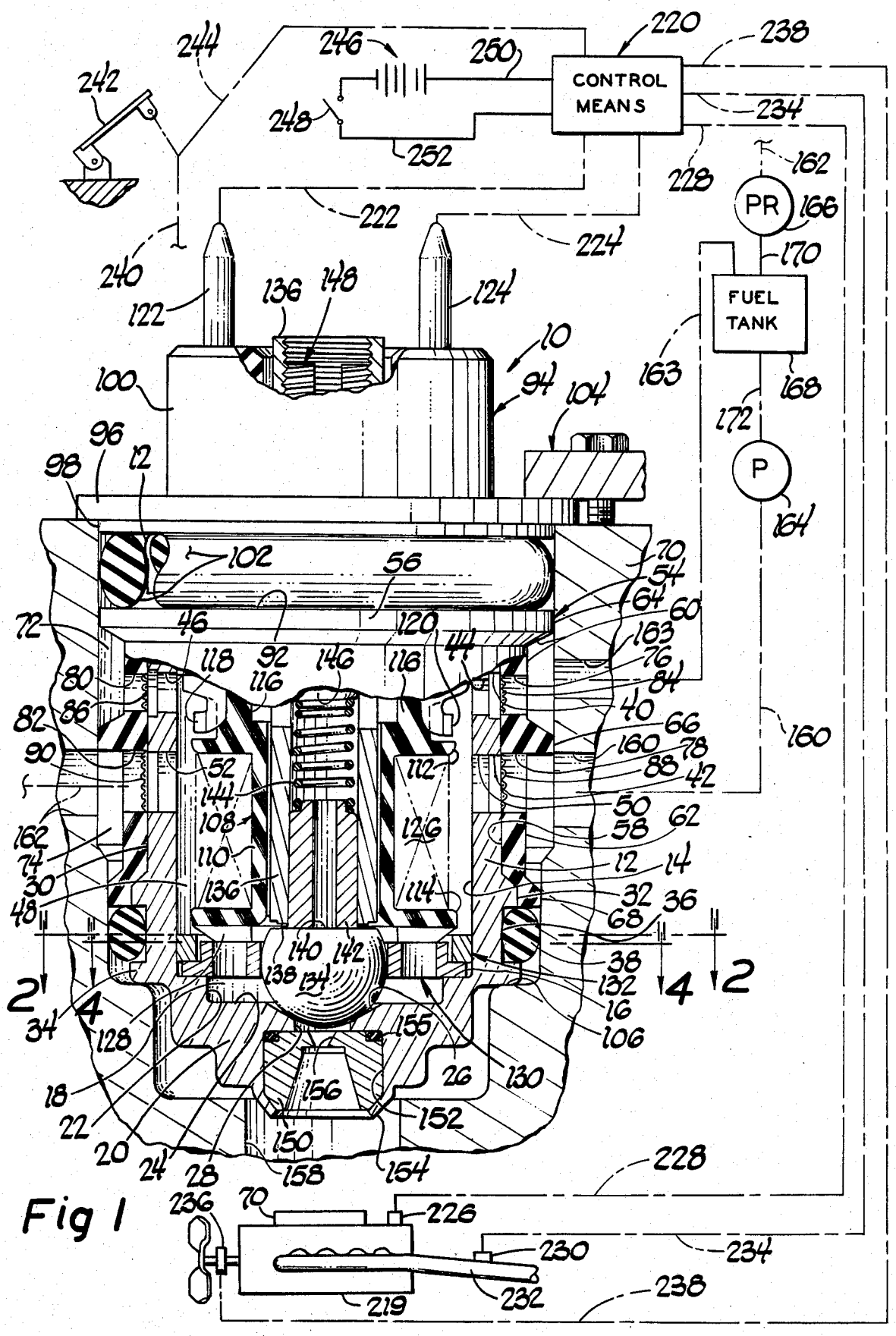
FIG. 1 is a view of an injector assembly, with portions thereof broken away and illustrated in axial cross-section, employing teachings of the invention, along with both diagrammatically and schematically illustrated elements and components depicting, in simplified manner, an overall fuel supply and metering system for an associated combustion engine.
Figure 2:
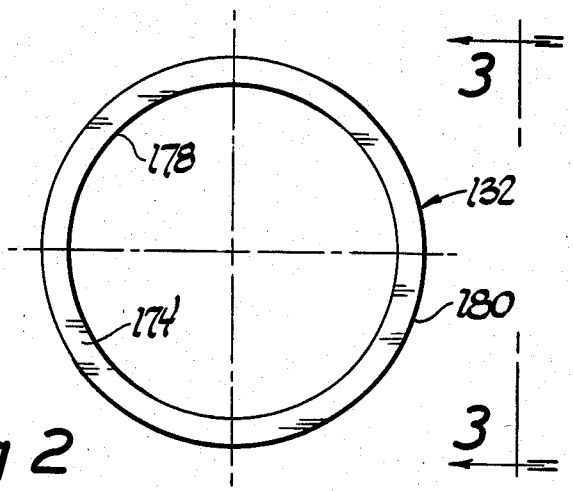
FIG. 2 is an elevational view, of one of the elements shown in FIG. 1, taken generally on the plane of line 2—2 of FIG. 1 and looking in the direction of the arrows.
Figure 3:
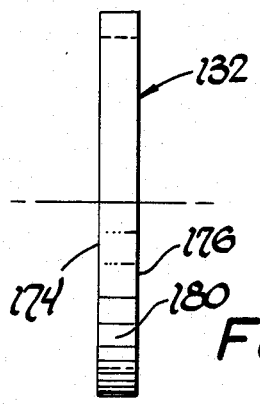
FIG. 3 is a view taken generally on the plane of line 3—3 of FIG. 2 and looking in the direction of the arrows.
Figure 4:
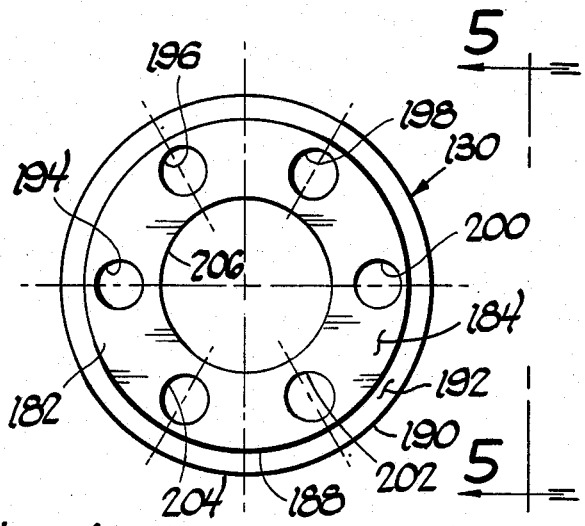
FIG. 4 is an elevational view, of one of the elements shown in FIG. 1, taken generally on the plane of line 4—4 of FIG. 1 and looking in the direction of the arrows.
Figure 5:
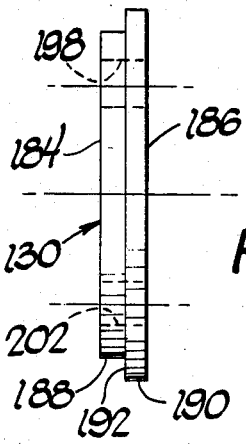
FIG. 5 is a view taken generally on the plane of line 5—5 of FIG. 4 and looking in the direction of the arrows.

Referring now in greater detail to the drawings, FIG. 1 illustrates a fuel injector assembly 10 as being comprised of a generally tubular cup-shaped main body or housing means 12 of magnetic material which is suitably open (not shown) at its upper end, as viewed in FIG. 1, as to thereby receive through said open end at least some of the components or elements illustrated as being situated therewithin.

As generally depicted, the housing means 12 is preferably provided with an axially extending inner cylindrical surface 14 which may terminate as in an annular flange-like or shoulder surface 16 which is directed radially inwardly from the inner cylindrical surface 14. A counter-bore or axially extending recess 18 is formed in the lower transverse axial end wall portion 20 of housing means 12 and, in the embodiment illustrated defines an inner cylindrical surface 22, which effectively intersects annular shoulder surface 16, and an axial end surface 24. Although other configurations of valve seating surface means are, of course, possible, in the embodiment illustrated a conical seating surface means 26 is formed in the lower axial end wall 20 and communicates with outlet passage means 28 also formed in said end wall 20.

The external surface 30 of housing means 12 is also of a generally cylindrical configuration and, among other things, is provided with annular flange-like portions 32 and 34 which cooperate to define an annular recess 36 which, in turn, is effective for receiving and holding an O-ring seal 38. Housing means 12 is also preferably provided with a plurality of axially spaced circumscribing annular recesses 40 and 42 formed in the outer cylindrical surface thereof. A first plurality of generally radially directed angularly spaced apertures or passages, two of which are shown at 44 and 46, are formed through housing 12 and serve to complete communication as between annular recess 40 and the interior 48 of housing or body means 12. A second plurality of generally radially directed angularly spaced apertures or passages, two of which are shown at 50 and 52, are formed through housing 12 and serve to complete communication as between annular recess 42 and the interior 48 of housing or body means 12.

A filter assembly 54 is illustrated as being comprised of a generally tubular body 56 of cylindrical configuration having its inner cylindrical surface 58 received at least closely against the outer surface 30 of housing means 12. Preferably, the body 56 is comprised of 33.0% glass-filled nylon resin. The upper end (as viewed in FIG. 1) of filter body 56 is open as to permit, for example, the extension therethrough of the upper end of housing means 12 as well as other related components and or elements. Filter body 56 is also preferably provided with a plurality of axially spaced circumscribing annular recesses 60 and 62 formed in the outer cylindrical surface thereof thereby defining annular flange-like portions 64, 66 and 68. When received within related support structure 70, a first annular chamber or passage 72 is formed generally by recess 60, flanges 64 and 66 and the interior of the support structure 70; similarly a second annular chamber or passage 74 is formed generally by recess 62, flanges 66 and 68 and the interior of the support structure 70.

A first plurality of generally radially directed angularly spaced apertures or passages, two of which are shown at 76 and 80, are formed through filter body 56 and serve to complete communication as between annular passage 72 and annular recess or passage 40. A second plurality of generally radially directed angularly spaced apertures or passages, two of which are shown at 78 and 82, are formed through filter body 56 and serve to complete communication as between annular passage 74 and annular recess or passage 50. The plurality of passages, as typified by passages 76 and 80, are respectively provided with filter screen means as typically respectively illustrated at 84 and 86 of passages 76 and 80. Similarly, the plurality of passages, as typified by passages 78 and 82, are respectively provided with filter screen means as typically respectively illustrated at 88 and 90 of passages 78 and 82.

The upper end of filter assembly 54 terminates as at the upper annular surface 92 of flange 64 whereas the housing means 12 may extend upwardly therebeyond and be at least partially contained within dielectric end cover means 94 which may comprise a disk-like member or portion 96, piloted as by a reduced diameter 98 in the support structure 70, and an upwardly directed cylindrical extension 100. An O-ring seal 102 is situated axially between surface 92 and member or end portion 96 and annularly confined as between the outer cylindrical surface of housing means 12 and the juxtaposed surface of support structure 70. Suitable clamping or retaining means 104, operatively engaged as with end portion 96 serves to hold the assembly 10 in assembled condition to the associated support structure 70 as by axially abutting the flange 34 against a cooperating annular shoulder or flange-like portion 106 of the support structure 70.

A bobbin 108 is depicted as comprising a centrally disposed tubular portion 110 with axially spaced radially extending end walls 112 and 114 along with a generally upwardly projecting portion 116 which, among other things is operatively structurally connected to respective one ends 118 and 120 of electrical terminals 122 and 124. A field coil 126 is wound generally about tubular portion 110 and axially contained between end walls 112 and 114. The ends of the wire forming the electrical coil 126 are electrically connected to ends 118 and 120, respectively, of electrical terminals 122 and 124. In the preferred embodiment a plurality of foot-like portions 128 are carried by the end wall 114 of bobbin 108 and are preferably angularly spaced about the axis of tubular portion 110 and, further, function as abutment means for axially abutting against the upper surface of an annular locator means 130.

An annular ring like member 132, press-fitted against inner surface means 14 of housing means 12, serves to maintain locator means 130 in a preselected position. As generally depicted, the locator means 130 serves to maintain a valve member 134, generally contained by locator 130, in a position to obtain optimum seating characteristics as between the valve member 134 and its cooperating seating surface 26.

A generally tubular pole piece 136 extends downwardly into the tubular portion 110 of bobbin 108 and is preferably provided with a stepped annular pole piece end face 138 which may be spaced from a flatted surface 140 of the depicted ball valve member 134, when such ball valve member is seated against surface means 26, in the order, for example, of 0.002 to 0.005 inch. The pole piece 136 may be threadably secured as to structure contained generally within the elevationally depicted portion of FIG. 1 whereby the relative axial position of the pole piece 136 may be adjusted as to, for example, determine the desired gap between surfaces 138 and 140.

A tubular guide pin 142, of preferably non-magnetic stainless steel, is slidably received with the core or pole piece means 136 and is normally resiliently urged downwardly (as viewed in FIG. 1) against valve 134 to urge said valve member into seated engagement with the associated seating surface means 26.

A spring 144 received as within the bore of pole piece means 136 is axially contained between and against the guide pin 142 and one end 146 of a spring adjuster screw 148 which is threadably engaged with pole piece means 136 and suitably sealed as by O-rings to prevent leakage therepast as is well known in the art. The purpose of such spring adjuster screw 148 is, of course, as is well known in the art, to attain the desired spring pre-load on guide pin 142.

A suitable nozzle-like fuel discharge member or insert 150 may be received with a bore 152 formed in end wall 20 of housing 12 and suitably secured therein as by the rolling-over of a portion 154 of the housing means 12. Suitable O-ring means 155 may be provided to prevent leakage between nozzle insert 150 and bore 152. Further, suitable metered fuel discharge orifice means 156 may be provided as at 156 as to flow through related passage means 158 to the engine induction system.

The associated support structure 70 is provided with conduit means 160, 162 and 163 with: (a) conduit means 160 serving to communicate between annular recess or passage 74 and fuel pump means 164; (b) conduit means 162 serving to communicate between annular recess or passage 74 and fuel pressure regulating means 166; and (c) conduit means 163 serving to communicate between annular passage or recess 72 and a fuel reservoir or fuel tank 168. The pressure regulator means 166 may be in communication with fuel tank means as via conduit means 170 while the fuel pump means 164 may be in communication with fuel tank means 168 as via conduit means 172.

Referring in greater detail to FIGS. 2–6, the retainer or locking means 132, which preferably is comprised of magnetic stainless steel material, is of cylindrical or ring-like configuration having axial end surfaces 174 and 176 along with a central aperture 178, preferably cylindrical, and an outer cylindrical surface 180. Although other forms are possible, in the preferred embodiment, as best shown in FIG. 1, the retainer means, in transverse cross-section, has a square-like or rectangular-like configuration.

The locator means or guide means 130, preferably comprised of magnetic stainless steel, is illustrated as comprising a disk-like body 182 having axial end surfaces 184 and 186. The body 182 has a first outer cylindrical surface 188 and a second outer cylindrical surface 190, relatively diametrically enlarged, and a radiating annular flange-like surface 192 operatively interconnecting the outer cylindrical surfaces 188 and 190. A plurality of passages 194, 196, 198, 200, 202 and 204 are formed through the locator means 130 as to provide for flow therethrough. In the preferred embodiment the total flow capacity of passages 194–204 far exceeds the maximum rate of metered fuel metered by the valving member 134; therefore, such passages 194–204 do not in any way alter the metering function or operation of the cooperating valve member 134 and valve seating means 26. The locator means or guide means 130 is also formed with a centrally located axially extending cylindrical passageway 206 which is effective for receiving the valving member 134. In one successful embodiment of the invention the diameter of the ball valve member 134 was 0.2810 inch while the diameter of passageway 206 was manufactured to a dimension of 0.2815/0.2820 inch thereby resulting in a minimum diametrical clearance (between the ball valve 134 and passageway 206) of 0.0005 inch and a maximum diametrical clearance of 0.0010 inch.

In the preferred embodiment, the valve member 134 is comprised of 52100 Grade chrome steel and such are readily commercially available to very exacting dimensional requirements. Further, as should be now clearly apparent, the valve member 134 also acts as the armature means in the overall injector assembly 10.

Figure 6:
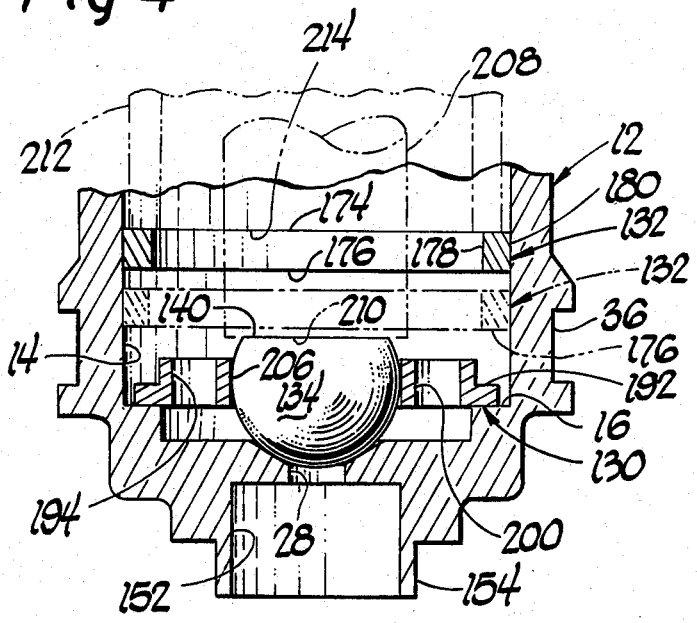
FIG. 6 is a view of a fragmentary portion of the injector assembly of FIG. 1 and illustrating one method for assembling the components shown therein.

As should be evident from both FIGS. 1 and 6, when the valve member 134 is fully seated upon valve seating surface means 26 and the locator or guide means 130 is situated as to be containing the valve 134 by its passageway 206, there is anannular clearance as between the larger outer diameter or cylindrical surface 190, of guide means 130, and the juxtaposed inner cylindrical surface 14 of housing means 12. Accordingly, it should be apparent that in order to have the valve 134 fully seated on the seat 26 and at the same time have the valve 134 slidably contained within passageway 206 there is no need for any critical dimensional concentricities as between: (a) outer cylindrical surface 190 and passageway 206 or (b) outer cylindrical surface 190 and seating surface means 26. Further, there is no need for the machining of critical dimensional concentricities as between passageway 206 and seating surface 26.

The foregoing will be even more apparent when assembly of the elements, as shown in FIG. 6, is considered with additional reference being made to FIG. 1. That is, for example, the valve 134 and locator or guide 130 may first be placed into the interior of the housing means 12 and a suitable arbor 208 may be moved against valve member 134, as by having arbor end 210 abut and press against flatted surface 140 of valve 134, to thereby urge valve 134 against seating surface means 26 and thereby fully seat the valve 134 against seat 26. While holding the valve 134 in such position, the retainer means 132 may be started into housing means 12. The outer cylindrical surface 180 of retainer 132 is of a dimension as to result in a press-fit relationship with housing means 12. Once the retainer 132 is thusly introduced into housing means 12 (with the valve 134 still being held in position, as previously described) by arbor means 208, a second arbor means 212, which may be of generally tubular configuration, operatively engages, as by its end surface 214, the upper axial end surface 174 of retainer 132 and progressively moves the retainer 132 downwardly (as viewed in FIG. 6) through various stages, one of which is depicted in phantom line in FIG. 6, until the retainer 132 is forcefully seated against guide means 130 by virtue of surface 176 of retainer 132 tightly abutting against the shoulder or flange surface 192 of guide means 130. When this is achieved, the elements here under consideration assume the relative positions depicted in FIG. 1 wherein it will be noted that even though the outer surface of retainer 132 is in press-fit engagement with inner surface 14 of housing means 12 and the axial end surface 176 is in a frictionally tight engagement with flange or shoulder surface 192 of guide means 130, there still remains a considerable annular space as between the inner passage 178 of retainer 132 and the juxtaposed portion of the outer cylindrical surface 188 of guide means 130. Consequently, in order to cause the guide means 130 to be in a locked position there is no need for any critical dimensional concentricities as between: (a) the outer cylindrical surface 180 of retainer or locking means 132 and the outer cylindrical surface 188 of guide means 130; (b) the outer cylindrical surface 180 of locking means 132 and the outer cylindrical surface 190 of locator 130; (c) the outer cylindrical surface 180 of retainer 132 and passageway or guideway 206 of guide means 130 or (d) the outer cylindrical surface 180 of retainer 132 and the seating surface means 26. Further, there is no need for any critical dimensional concentricities as between inner clearance surface 178 and any of above-mentioned surfaces of the guide means 130 or the seating surface means 26. Still further, there is no need for any critical dimensional concentricities as between opening 178 and outer surface 180 of retainer 132 nor is there even a need for the opening 178 to be made to a critical (very close dimensional tolerance) diametral dimension.

Operation of the Invention

With particular reference to FIG. 1, the fuel pump means 164 (which may be mounted internally of fuel tank 168) supplies fuel under superatmospheric pressure via conduit means 160 to annular chamber 74 from where such fuel flows through the plurality of ports or passages 78 and 82 (which may be only two of many), through the filter means 88 and 90 and into annulus 42 of housing means 12 from where, in turn, such fuel flows into the interior space 48 as via the plurality of ports or passages 50 and 52 (which also may be only two of many). Any excess fuel is returned to the fuel reservoir or tank 168 as via conduit means 162, communicating with annulus 74, which is serially connected to suitable pressure regulating means 166 and return conduit means 170. Any fuel vapors which may occur within the assembly 10 are permitted to flow out and return as to fuel tank 168 as via conduit means 163 which may contain series situated calibrated restriction means (not shown).

The fuel under superatmospheric pressure thusly provided to cavity or space 48 of course also flows through the spaces between the plurality of legs 128 and through the passages or conduits 194–204 of guide means 130 into the chamber or counter-bore 18. As the armature valve 134 is moved upwardly off its cooperating seat 26, fuel passes between the opened valve 134 and seat 26 and into passage 28 from where it is discharged as via nozzle discharge passage means 156 into the engine 219 induction system.

As depicted in FIG. 1, the terminal means 122 and 124 may be respectively electrically connected as via conductor means 222 and 224 to related electronic control means 220 and as should already be apparent, the metering means 10 is of the duty-cycle type wherein the winding or coil means 126 is intermittently energized thereby causing, during such energization, armature valve member 134 to move in a direction away from valve seat 26. Consequently, the effective flow area of the flow orifice thusly cooperatively defined by the armature valve member 134 and valve seat 26 can be variably and controllably determined by controlling the frequency and/or duration of the energization of coil means 126.

The control means 220 may comprise, for example, suitable electronic logic type control and power output means effective to receive one or more parameter type input signals and in response thereto produce related outputs. For example, engine temperature responsive transducer means 226 may provide a signal via transmission means 228 to control means 220 indicative of the engine temperature; sensor means 230 may sense the relative oxygen content of the engine exhaust gases (as within engine exhaust conduit means 232) and provide a signal indicative thereof via transmission means 234 to control means 220; engine speed responsive transducer means 236 may provide a signal indicative of engine speed via transmission means 238 to control means 220 while engine load, as indicated for example by the position of the engine induction system throttle valve (not shown but known in the art), may provide a signal as via transmission means 240 operatively connected to the engine operator's foot-actuated throttle pedal lever 242 and operatively connected as by the same transmission means or associated transmission means 244 to control means 220. A source of electrical potential 246 along with related switch means 248 may be electrically connected as by conductor means 250 and 252 to control means 220. The rate of metered fuel flow, in the embodiment disclosed, will be dependent upon the relative percentage of time, during an arbitrary cycle time or elapsed time, that the valve member 134 is relatively close to or seated against seat 26 as compared to the percentage of time that the valve member 134 is opened or away from the cooperating valve seat 26.

This is dependent on the output to coil means 126 from control means 220 which, in turn, is dependent on the various parameter signals received by the control means 220. For example, if the oxygen sensor and transducer means 230 senses the need of a further fuel enrichment in the motive fluid being supplied to the engine and transmits a signal reflective thereof to the control means 220, the control means 220, in turn, will require that the metering valve 134 be opened a greater percentage of time as to provide the necessary increased rate of metered fuel flow. Accordingly, it will be understood that given any selected parameters and/or indicia of engine operation and/or ambient conditions, the control means 220 will respond to the signals generated thereby and respond as by providing appropriate energization and de-energization of coil means 126 (causing corresponding movement of valve member 134) thereby achieving the then required metered rate of fuel flow to the engine 219.

More particularly, assuming that the coil means 126 is in its de-energized state, spring 144 will urge the guide pin 142 (which is axially slidable within core or pole piece means 136) downwardly causing the lower axial end face of the guide pin 142 to urge against the flatted surface 140 of armature valve 134 and hold the valve 134 in a sealed seating engagement with seat means 26 thereby preventing fuel flow therepast into conduit 28.

When coil means 126 becomes energized a magnetic flux is generated and such flux path includes armature valve 134 and core or pole piece means 136. As a consequence of such flux field, armature valve 134 is drawn upwardly pushing with it the guide pin 142 against the resilient resistance of spring means 144. Such upward movement of the armature valve 134 continues until the flatted surface 140 of armature valve 134 abuts against pole piece end face means 138. Such total stroke or travel of valve member 134, from its seated or closed position to its fully opened position against pole piece means 136, 138, may be, for example, in the order of 0.005 inch. It should be clear that during the entire opening stroke as well as during the entire closing stroke, the valve member 134 is guided within and by guide passage 206 of the locator or guide means 130.

When the energization of field coil means 126 is terminated, spring 144, through guide pin 142, moves valve member downwardly through its down stroke until the valve 134 is sealingly seated against cooperating seating surface means 26. Such sealing seating of the valve 134 is assured because of: (a) the previously described alignment of the valve member 134 and guide means 130 during assembly thereof into housing means 12 and (b) the very close clearance as between the valve member 134 and guide surface means 206 of guide means 130. Consequently, in the embodiment disclosed, the valve member 134 would have a minimum available side-ways movement (transverse to the direction of its stroke), relative to guide surface means 206 and valve seat 26, of 0.0005 inch and a maximum available side-ways movement of 0.0010 inch (if the surface 206 of guide means 30 were machined to its maximum diametrical dimension). This, in turn, means that even if the valve member 134, during its down or closing stroke, were to move laterally its maximum permissible amount, it would only be 0.0005 inch out of concentricity with the valve seat 26 when the valve first contacted the valve seat. With such a small degree of eccentricity, it would require the valve 134 to move laterally only 0.0005 inch to achieve full sealing seating engagement with the valve seat 26 and such lateral movement would be assisted by the slope of the valve seat means 26 as the valve still continued some degree of downward movement caused by spring means 144 until full sealing seating engagement was achieved.

The invention as herein disclosed is the preferred embodiment and the invention may be practiced in other forms or modifications. For example, the valve member 134, even though preferred to be of generally spherical configuration, may actually be of any desired configuration as, for example, a cylindrical valve body having a spherical or conical end valving portion. In the event that a conical end valving portion were to be employed, it would then be preferred to have a seating surface which was curvilinear in axial cross-section with the wider portion thereof opening upwardly generally in the direction of the valving member.

Further, it is also contemplated that instead of having the inner diameter 14 of uniform dimension, such may be formed as to have a major axial length of the inner surface 14 of a relatively larger dimension as not to result in a press-fit with retainer or locking means 132 and to provide only a relatively short axial length of such inner surface 14 with an annular portion of reduced diameter which would result in a press-fit with retainer 132. Such a relatively short axial length could be in the area generally surrounding the retainer 132 when it is seated against guide means 130 as depicted in FIG. 1 thereby eliminating the need to press-fit the retainer 132 the full length of inner surface 14.

The invention as disclosed herein may be employed in fuel systems which are commonly referred to as single point injection systems wherein an injector assembly (or injector assemblies) is employed for injecting fuel into the total air stream being supplied to the engine; the invention may also be employed in fuel systems which are commonly referred to as port injection systems wherein a plurality of injector assemblies are provided to respectively supply metered fuel to corresponding respective engine cylinders thereby providing a metered rate of fuel which is sufficient only for the demands of such respective engine cylinder.

Further, as should also be apparent, the invention as herein disclosed may be employed for the metering of fluids other than fuel and, of course, is not limited in use to an engine fuel system.

The various details not specifically shown in FIG. 1 because of the portion thereof shown in elevation are generally well known in the art and the specific description thereof is not necessary in order to understand and practice the invention.

Although only a preferred embodiment of the invention has been disclosed and described it is apparent that other embodiments and modifications of the invention are possible within the scope of the appended claims.

What is claimed is:

1. A valving assembly for metering the rate of flow of a fluid, comprising housing means, electrical field coil means carried by said housing means, pole piece means situated generally within said field coil means, valve seat means, fluid flow passage means formed through said valve seat means, said pole piece means comprising a pole piece axial end portion, a valve member situated generally between said pole piece means axial end portion and said valve seat means, wherein said valve member also serves as an armature means to be acted upon by the flux field generated by said field coil means when energized, resilient means normally operatively resiliently urging said valve member in a first direction toward operative seating engagement with said valve seat means as to thereby terminate flow of said fluid through said fluid flow passage means, wherein said field coil means when energized creates said flux field causing said valve member to move in a second direction opposite to said first direction away from said valve seat means as to thereby permit flow of said fluid through said fluid flow passage means, guide means physically separate from but operatively carried by said housing means, said guide means closely confining said valve member as to allow said valve member to be freely moved in said first and second directions while effectively limiting movement of said valve member in directions transverse to said first and second directions, said guide means being moveable with respect to said housing means in directions transverse to said first and second directions to a selected location, and means for locking said guide means in said selected location as to thereby assure that said guide means properly guides said valve member to a seated condition against said valve seat means.

2. A valving assembly according to claim 1 wherein said guide means comprises guide passage means formed therethrough, said guide passage means closely confining said valve member as to allow said valve member to be freely moved in said first and second directions while effectively limiting movement of said valve member in directions transverse to said first and second directions, said guide passage means being effective to thusly closely confine said valve member during the full movement of said valve member in both said first and second directions.

3. A valving assembly according to claim 1 wherein said valve member has a spherical configuration.

4. A valving assembly for metering the rate of flow of a fluid, comprising housing means, electrical field coil means carried by said housing means, pole piece means situated generally within said field coil means, valve seat means, fluid flow passage means formed through said valve seat means, said pole piece means comprising a pole piece axial end portion, a valve member situated generally between said pole piece means axial end portion and said valve seat means, wherein said valve member also serves as an armature means to be acted upon by the flux field generated by said field coil means when energized, resilient means normally operatively resiliently urging said valve member in a first direction toward operative seating engagement with said valve seat means as to thereby terminate flow of said fluid through said fluid flow passage means, wherein said field coil means when energized creates said flux field causing said valve member to move in a second direction opposite to said first direction away from said valve seat means as to thereby permit flow of said fluid through said fluid flow passage means, guide means closely confining said valve member as to allow said valve member to be freely moved in said first and second directions while effectively limiting movement of said valve member in directions transverse to said first and second directions, and retainer means, being effective to lock said guide means against movement relative to said housing means as to thereby assure that said guide means properly guides said valve member to a seated condition against said valve seat means, wherein said guide means in the absence of said retainer means is movable in directions transverse to said first and second directions.

5. A valving assembly according to claim 4 wherein said valve member comprises a spherical configuration.

6. A valving assembly according to claim 4 wherein said valve member comprises a first surface portion of a spherical-like configuration and a second flatted surface portion, and wherein said flatted surface portion is juxtaposed to said pole piece means.

7. A valving assembly for metering the rate of flow of a fluid, comprising housing means, electrical field coil means carried by said housing means, pole piece means situated generally within said field coil means, valve seat means, fluid flow passage means formed through said valve seat means, said pole piece means comprising a pole piece axial end portion, a valve member situated generally between said pole piece means axial end portion and said valve seat means, wherein said valve member also serves as an armature means to be acted upon by the flux field generated by said field coil means when energized, resilient means normally operatively resiliently urging said valve member in a first direction toward operative seating engagement with said valve seat means as to thereby terminate flow of said fluid through said fluid flow passage means, wherein said field coil means when energized creates said flux field causing said valve member to move in a second direction opposite to said first direction away from said valve seat means as to thereby permit flow of said fluid through said fluid flow passage means, guide means closely confining said valve member as to allow said valve member to be freely moved in said first and second directions while effectively limiting movement of said valve member in directions transverse to said first and second directions, and retainer means, said retainer means being effective to lock said guide means against movement relative to said housing means as to thereby assure that said guide means properly guides said valve member to a seated condition against said valve seat means, wherein said retainer means comprises peripheral surface means and end surface means generally transverse to said peripheral surface means, wherein said peripheral surface means is in a press-fit relationship to said housing means, and wherein said end surface means is in abutting frictional engagement with said guide means.

8. A valving assembly according to claim 7 wherein said valve member comprises a spherical configuration.

9. A valving assembly according to claim 7 wherein said valve member comprises a first spherical-like surface portion and a second flatted surface portion, and wherein said flatted surface portion is juxtaposed to said pole piece means.

10. A valving assembly for metering the rate of flow of a fluid, comprising housing means, electrical field coil means carried by said housing means, pole piece means situated generally within said field coil means, valve seat means, fluid flow passage means formed through said valve seat means, said pole piece means comprising a pole piece axial end portion, a valve member situated generally between said pole piece means axial end portion and said valve seat means, wherein said valve member also serves as an armature means to be acted upon by the flux field generated by said field coil means when energized, resilient means normally operatively resiliently urging said valve member in a first direction toward operative seating engagement with said valve seat means as to thereby terminate flow of said fluid through said fluid flow passage means, wherein said field coil means when energized creates said flux field causing said valve member to move in a second direction opposite to said first direction away from said valve seat means as to thereby permit flow of said fluid through said fluid flow passage means, guide means closely confining said valve member as to allow said valve member to be freely moved in said first and second directions while effectively limiting movement of said valve member in directions transverse to said first and second directions, and retainer means, said retainer means being effective to lock said guide means against movement relative to said housing means as to thereby assure that said guide means properly guides said valve member to a seated condition against said valve seat means, wherein said guide means comprises disk-like body means operatively engaging shoulder-like abutment means carried by said housing means, first peripheral surface means formed on said disk-like body means, wherein said retainer means comprises a generally annular member, second peripheral surface means formed on said generally annular member, said generally annular member further comprising end surface means generally transverse to said second peripheral surface means, wherein said second peripheral surface means is in a press-fit relationship to said housing means, wherein said end surface means is in abutting frictional engagement with said guide means, and wherein a space circumscribes said first peripheral surface means as to be between said first peripheral surface means and said housing means.

11. A valving assembly according to claim 10 and further comprising second fluid flow passage means formed through said disk-like body means.

12. A valving assembly according to claim 11 and further comprising guide passage means formed through said disk-like body means for closely confining said valve member, wherein said second fluid flow passage means comprises a plurality of second fluid flow passages, and wherein said plurality of second fluid flow passages are formed through said disk-like body means at locations radially outwardly of said guide passage means and angularly spaced from each other.

13. A valving assembly according to claim 10 wherein said valve member comprises a spherical configuration.

14. A valving assembly according to claim 10 wherein said valve member comprises a first spherical-like surface portion and a second flatted surface portion, and wherein said flatted surface portion is juxtaposed to said pole piece means.

15. A duty-cycle type injector assembly having a valving member and cooperating valve seating means wherein said valving member is positioned away from or against said valve seating means depending upon the energization and de-energization of associated field coil means, comprising housing means for the containment of said valving member and said valve seating means, locator means closely confining said valving member as to allow said valving member to be freely moved in first directions toward and away from said valve seating means while constraining movement of said valving member in second directions perpendicularly transverse to said first directions, wherein when said valving member is fully seated against said valve seating means said locator means is in a spaced condition from said housing means in directions which are generally parallel to said second directions, and locking means operatively engaging said locator means and said housing means for maintaining said locator means in said spaced condition regardless of whether said valving member has been moved away from said valve seating means or toward and seated against said valve seating means.

16. A duty-cycle type injector assembly according to claim 15 wherein said locking means comprises peripheral surface means and end surface means generally transverse to said peripheral surface means, wherein said peripheral surface means is in a press-fit relationship to said housing means, and wherein said end surface means is in abutting frictional engagement with said locator means.

17. A duty-cycle type injector assembly according to claim 16 wherein said locator means comprises a disk-like body means, and further comprising guide passage means formed through said disk-like body means for closely confining said valving member, and wherein said locking means comprises a generally annular member.

18. A duty-cycle type injector assembly according to claim 17 and further comprising a plurality of fluid flow passages formed through said disk-like body means.

19. A duty-cycle type injector assembly according to claim 15 wherein said valving member comprises a spherical configuration.

20. A duty-cycle type injector assembly having a valving member and cooperating valve seating means wherein said valving member is positioned away from or against said valve seating means depending upon the energization and deenergization of associated field coil means, comprising housing means for the containment of said valving member and said valve seating means, locator means closely confining said valving member as to allow said valving member to be freely moved in first directions toward and away from said valve seating means while constraining movement of said valving member in second directions transverse to said first directions, wheren when said valving member is fully seated against said valve seating means said locator means is in a spaced condition from said housing means in directions which are generally parallel to said second directions, and locking means operatively maintaining said locator means in said spaced condition regardless of whether said valving member has been moved away from said valve seating means or toward and seated against said valve seating means.

21. A method of constructing a valving assembly wherein a valve member is intended to at times be seated against a cooperating valve seat to thereby terminate fluid flow therepast and at other times be moved away from said cooperating valve seat to thereby permit fluid flow therepast, said method comprising the steps of forming housing body means having internally disposed side surface means, forming fluid flow passage means in said housing body means, forming a valve seat in said housing body means generally about said fluid flow passage means, forming a valve member, forming a valve guide member, forming a retainer, placing said valve member within said housing body means, placing said valve guide member within said housing body means generally about said valve member as to closely contain said valve member, seating said valve member against said valve seat while permitting said valve guide member to surround said valve member and be located thereby, and while maintaining said valve member seated against said valve seat press-fitting said retainer into said housing body means until said retainer operatively abuts against and frictionally holds said valve guide member against movement.

* * * * *